US005174568A

United States Patent [19]

You

[11] Patent Number: 5,174,568

[45] Date of Patent: Dec. 29, 1992

[54] RACKET FRAME

[76] Inventor: Chin-San You, No. 3, Lane 1029, Feng-Shyn Road, Feng Yuan City, Taichung Hsien, Taiwan

[21] Appl. No.: 818,202

[22] Filed: Jan. 8, 1992

[51] Int. Cl.[5] ..... A63B 49/10

[52] U.S. Cl. ..... 273/73 F; 273/73 C; 273/73 G

[58] Field of Search ..... 273/73 R, 73 C, 73 D, 273/73 F, 73 G, 73 J

[56] References Cited

U.S. PATENT DOCUMENTS

| | | | |
|---|---|---|---|
| 3,930,920 | 1/1976 | Kicherer | 273/73 F X |
| 4,114,880 | 9/1978 | Cecka | 273/73 F X |
| 4,203,596 | 5/1980 | Nagamoto | 273/73 F X |
| 4,399,992 | 8/1983 | Molitor | 273/73 F |
| 4,429,873 | 2/1984 | Van Raemdonck | 273/73 F |
| 5,029,858 | 7/1991 | Chen | 273/73 F |
| 5,039,096 | 8/1991 | Chen | 273/73 G |

FOREIGN PATENT DOCUMENTS

| | | | |
|---|---|---|---|
| 0077134 | 4/1983 | European Pat. Off. | 273/73 F |
| 2069342 | 8/1981 | United Kingdom | 273/73 F |

*Primary Examiner*—V. Millin
*Assistant Examiner*—William E. Stoll
*Attorney, Agent, or Firm*—Browdy and Neimark

[57] ABSTRACT

A highly shock-absorbing racket frame of fiber reinforcing plastic material comprising an outer shell made from a plurality of fiber fabric sheets preimpregnated in epoxy resin and made up of fibers arranged in a predetermined orientation. The outer shell located in the head portion and the shaft portion is provided with at least one shock-absorbing portion fitted into a tubular bridging in a manner such that they are adhered securely. A first reinforcing is used to cover across a bordering portion of one end of the bridging and outer shell in addition to a surface adjacent to bridging and outer shell. A second reinforcing is used to cover across the bordering portion of another end of the bridging and outer shell in addition to the surface adjacent to the bridging and outer shell. The shock wave generated in the head portion is effectively absorbed and mitigated by the shock-absorbing portion.

16 Claims, 5 Drawing Sheets

RACKET FRAME

BACKGROUND OF THE INVENTION

The present invention relates to a racket frame, and more particularly to a racket frame made from fiber reinforced plastic material and provided with an excellent shock-absorbing capability.

In general, the conventional prior art racket frame made from fiber reinforced plastic material is provided with a multi-layered outer shell, which is made from the intertwined sheets of fiber fabric made up of unidirectionally oriented fibers preimpregnated in epoxy resin prior to being treated under heat and pressure in the molding tool. In other words, such outer shell of the racket frame is made up of the same fiber reinforced plastic material extending uniformly and uninterruptedly throughout the entire racket frame. As a result, a player's hand holding the racket is subjected to injury caused by the shock transmitted easily to the grip portion from the head frame upon being impacted by a ball.

In order to find a solution to such problem, a number of new products have been developed and introduced, as exemplified in the Taiwan Patent No. 78201997 disclosing a racket frame having a hand grip capable of absorbing shock. Such racket frame comprises a shock-absorbing elastic body embedded in the junction between the shaft and the hand grip. Such racket is defective in design in that its hand grip is vulnerable to falling apart from the shaft after a prolonged usage of the racket.

Another category of the structures is disclosed in the Taiwan Patent No. 78210299 and has to do with a racket having a shaft provided with a plurality of grooves, in each of which a shock-absorbing girdle is set firmly so as to intercept the shock transmitted from the head frame. Such racket frame is also defective in design in that its shock-absorbing capability is greatly undermined in view of the fact that the shock-absorbing girdle can be eventually loosened up by the shock wave and even become detached.

SUMMARY OF THE INVENTION

It is therefore the primary objective of the present invention to provide a racket frame made from fiber reinforced plastic material with improved means capable of absorbing effectively the shock generated by the impact of a ball on the racket.

In keeping with the principles of the present invention, the primary objective of the present invention is accomplished by an improved racket frame having a head portion, a shaft portion, a grip portion, and an outer shell made by means of compression molding from the first fiber fabric containing a plurality of sheets made up of fibers arranged in a predetermined orientation and preimpregnated in the thermosetting resin. The racket frame of the present invention is characterized in that its outer shell is provided with a shock-absorbing portion located at the area extending toward the head portion from the junction of the shaft portion and the grip portion. A binding member of tubular construction made from plastic material is fitter over the shock-absorbing portion before the outer shell has been cured completely during the manufacturing process of the racket. As a result, the surface of the shock-absorbing portion is securely adhered to the tubular wall of the bridging member at the time when the curing of outer shell is brought to a completion. In addition, the racket frame of the present invention is further provided with a first reinforced layer and a second reinforced layer, which are made from the second fiber fabric containing a plurality of sheets made up of fibers arranged in a predetermined orientation and preimpregnated in the thermosetting resin. The first reinforced layer is disposed in such a manner that it covers across one end of the bridging member and the portion of the outer shell adjacent to that one end of the bridging member, while the second reinforced layer is arranged in such a way that it covers across other end of the bridging member and the portion of the outer shell neighboring that other end of the bridging member. The constructions of both first and second reinforced layers are implemented during the manufacturing process in which the curing has not been completed. Upon the completion of curing process of the reinforced layers, both ends of the bridging member are firmly set on the surfaces of first reinforced layer, second reinforced layer, and shock-absorbing portion. Therefore, the shock wave traveling from the head portion to the grip portion is effectively absorbed and greatly mitigated by the shock-absorbing portion. As a result, a player's hand holding the racket of the present invention is not subjected to injury brought about by the shock generated by the impact of a ball hitting the head portion of the racket.

The racket frame of the present invention is further characterized in that the number of layers of fiber fabric at the shock-absorbing portion is less than that of any other portion of the racket frame, and that each layer of fiber fabric making up the shock-absorbing portion is broken by interruption.

DETAILED DESCRIPTION OF THE PREFERRED EMBODIMENTS

Figure 1:
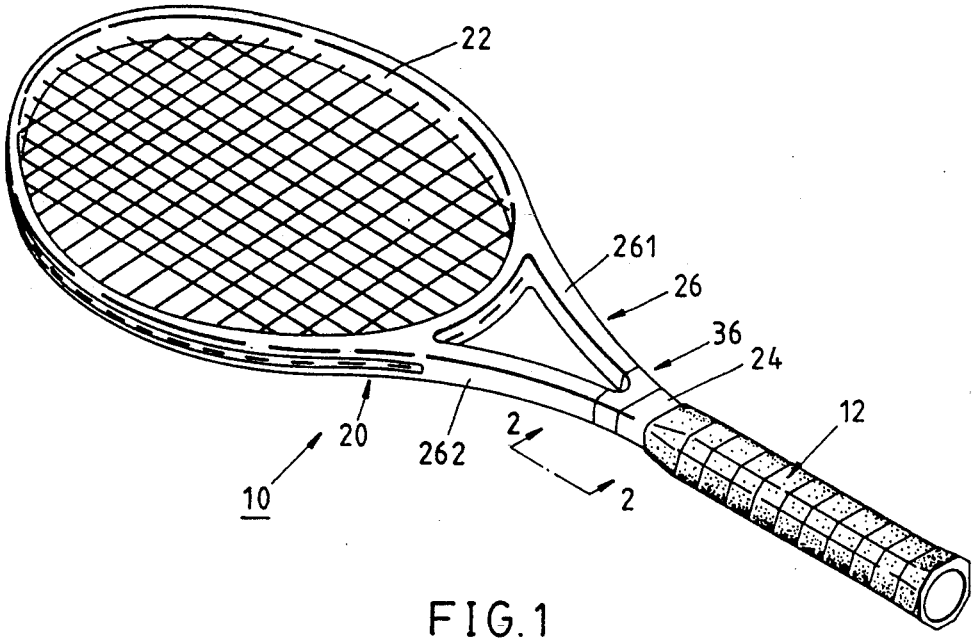
FIG. 1 shows a three-dimensional view of the first preferred embodiment of the present invention.
Figure 2:
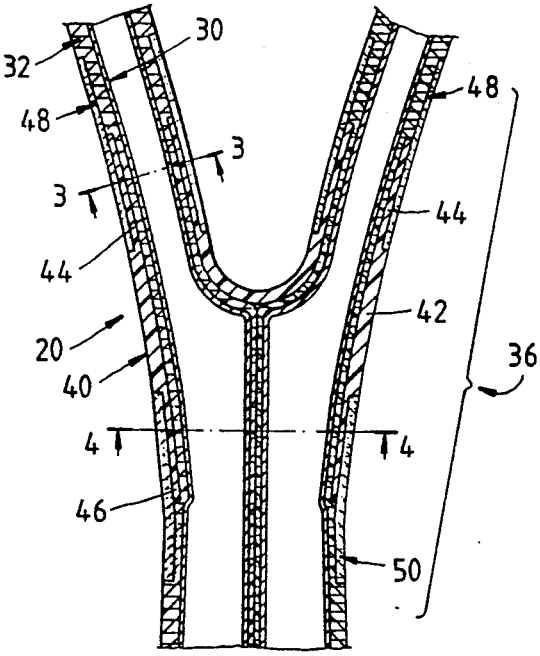
FIG. 2 shows a sectional view of the portion taken along the line 2—2 as shown in FIG. 1.

Referring to FIGS. 1, 2, 3, and 4, the racket 10 of the first preferred embodiment of the present invention is shown comprising a racket frame 20 having a head portion 22, a grip portion 24, and a shaft portion 26 bridging the head portion 26 and the grip portion 24. The shaft portion 26 is ramified into two branches 261 and 262, while the grip portion 24 is covered with a protective jacket 12.

The racket frame 20 is composed of a cellophane tube 30 covered with an outer shell 32 made by means of compression molding from the first fiber fabric which contains fibers arranged in a predetermined orientation and which is preimpregnated in epoxy resin. The outer shell 32 comprises a shock-absorbing portion 36 located at the bordering portion of the grip portion 24 and the shaft portion 26. The racket frame 20 is further provided with a tubular bridging member 40, which is made from polyurethane (PU), polyethylene (PE), and epoxy resin and is composed of a main body 42 having two front branched tubes 44 and a rear connection tube 46. The outer shell 32 located correspondingly to the branches 261 and 262 passes through the front branched tubes 44 and then joins with the main body 42 before passing through the rear connection tube 46. The racket frame 20 is still further provided with a first reinforced layer 48 and a second reinforced layer 50, which are made from a carbonaceous fiber fabric smaller than the first fiber fabric and made up of a plurality of sheets of a width and a length preimpregnated in epoxy resin and provided with fibers arranged in a predetermined orientation. The first reinforced layers 48 are used to cover respectively the surface neighboring the front branched tube 44 and the branch 261 and the surface neighboring the front branched tube 44 and the branch 262 in such a manner that they are arranged respectively across the contact portions between the front branched tubes 44 and the branches 261 and 262. The second reinforced layer 50 is used to cover the surface adjacent to the rear connection tube 46 and the shaft portion 26 in such a manner that it is arranged across the contact portion between the rear connection tube 46 and the rear segment of the shaft portion 26.

Figure 5:
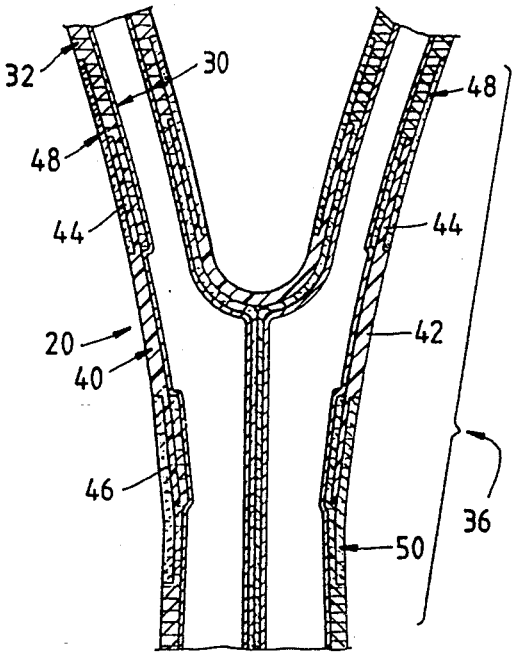
FIG. 5 is a sectional view of the portion taken along the line 2—2 as shown in FIG. 1, showing that the portion of fiber fabric located at the shock-absorbing portion is broken by interruption.
Figure 3:
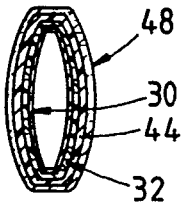
FIG. 3 shows a sectional view of the portion taken along the line 3—3 as shown in FIG. 2.
Figure 4:
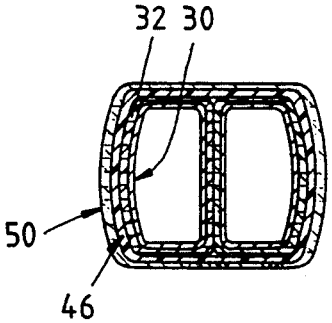
FIG. 4 shows a sectional view of the portion taken along the line 4—4 as shown in FIG. 2.

In the process of manufacturing the racket frame 20, the shock-absorbing portion 36 of the outer shell 32 is embedded into the bridging member 40 prior to the curing process. The first and the second reinforced layers 48 and 50 are set on the surfaces of the bridging member 40 and the outer shell 32 prior to the curing process. Finally, the outer shell 32 and the bridging member 40 are placed in the molding tool, in which they are treated under heat and pressure to cure to take form. During such molding process, portions of epoxy resin contained in the outer shell 32 and the bridging member 40 are released under heat and pressure so that the contact portions of the outer shell 32 and the bridging member 40 are securely adhered. As a result, the shock wave traveling down from the head portion 22 to the shock-absorbing portion 36 will be absorbed by the bridging member 40. In order to enhance the shock-absorbing effect, the number of the fiber fabric layers at the shock-absorbing portion 36 may be reduced appropriately. For example, if other portions of the racket frame 20 are made from six layers of fiber fabric, the number of the fiber fabric layers making up the shock-absorbing portion 36 may be reduced to three, or the fiber fabric at the shock-absorbing portion 36 may be broken by interruption, as shown in FIG. 5, so as to obstruct effectively the transmission of the shock wave.

Figure 6:
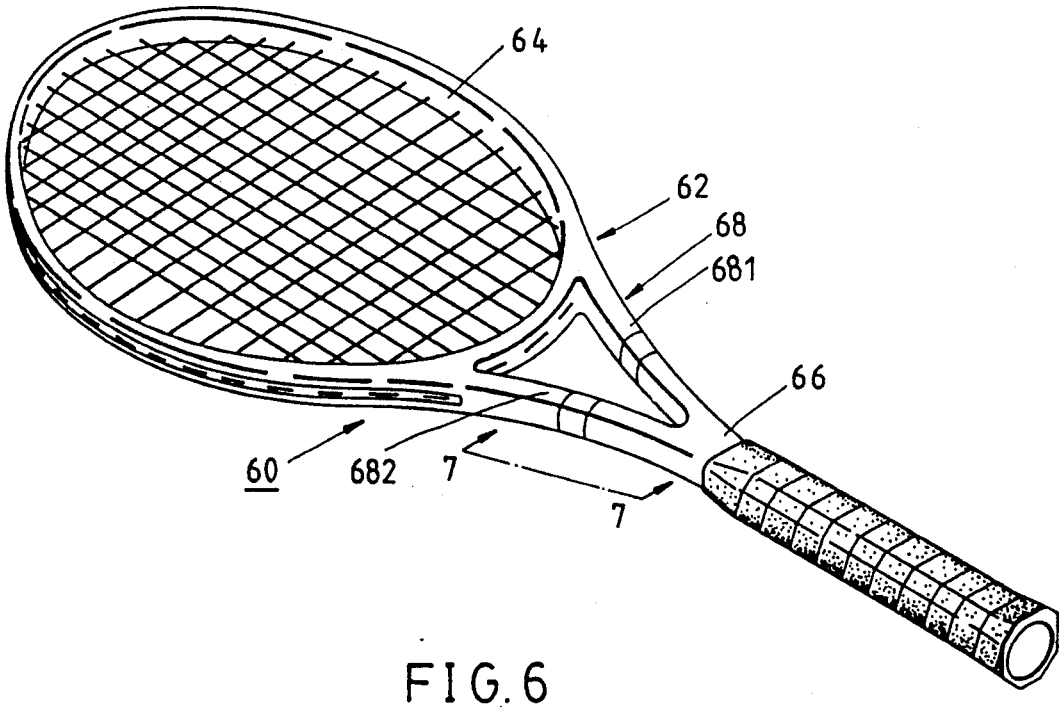
FIG. 6 shows a three-dimensional view of the second preferred embodiment of the present invention.
Figure 7:
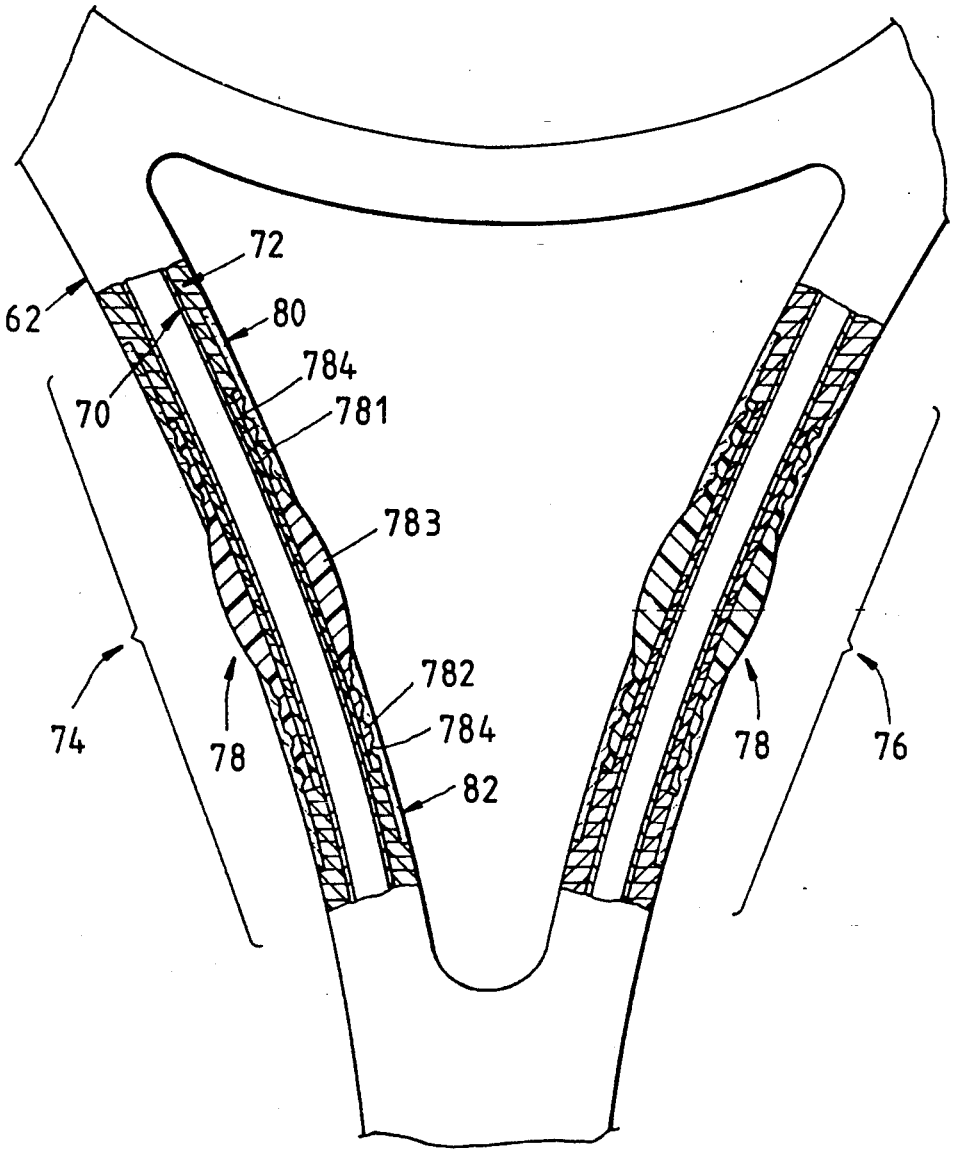
FIG. 7 shows a sectional view of the portion taken along the line 7—7 as shown in FIG. 6.
Figure 8:
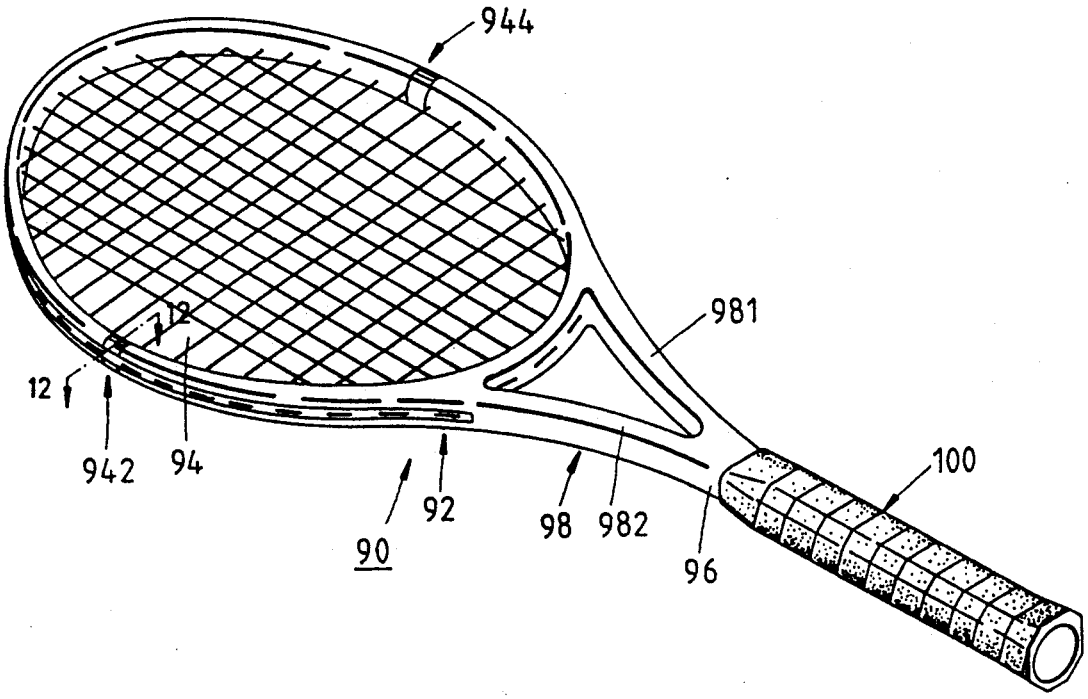
FIG. 8 shows a three-dimensional view of the third preferred embodiment of the present invention.
Figure 9:
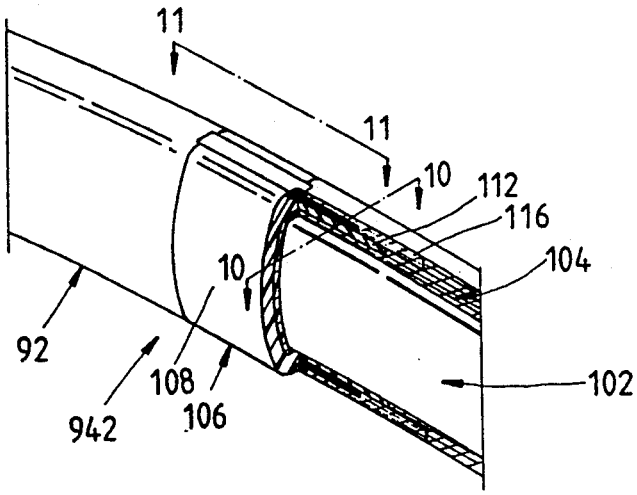
FIG. 9 shows a three-dimensional sectional view of a portion of the third preferred embodiment of the present invention.
Figure 10:
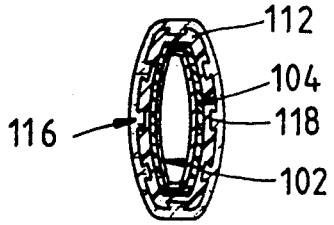
FIG. 10 shows a sectional view of the portion taken along the line 10—10 as shown in FIG. 9.
Figure 11:
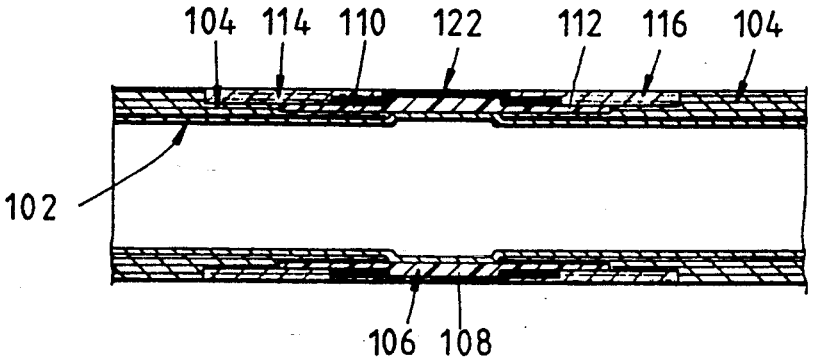
FIG. 11 shows a sectional view of the portion taken along the line 11—11 as shown in FIG. 9.

Now referring to FIGS. 6 and 7, the racket 60 of the second preferred embodiment of the present invention is shown comprising a racket frame 62 having a head portion 64, a grip portion 66, and a shaft portion 68 connecting the head portion 64 and the grip portion 66. The shaft portion 68 is provided with two branches 681 and 682 extending toward the head portion 64. The racket frame 62 comprises a cellophane tube 70, and an outer shell 72. The cellophane tube 70 is wrapped around with six layers of the carbonaceous fiber fabric preimpregnated in epoxy resin and made up of fibers arranged in orientations on the order of $\pm 0°$, $\pm 30°$, and $\pm 45°$.

The racket frame 62 of the second preferred embodiment of the present invention is provided with shock-absorbing portions 74 and 76 in the outer shell 72 located correspondingly to the two branches 681 and 682 of the shaft portion 68. Each of the shock-absorbing portions 74 and 76 is fitted respectively into the tubular bridging members 78 made from polyurethane (PU), polyethylene (PE), and epoxy resin. Each of the shock-absorbing portions 74 and 76 is made up of only three layers of carbonaceous fiber fabric.

The bridging member 78 is composed of a front connection tube 781 and a rear connection tube 782, and a ridged portion 783 located between the front connection tube 781 and the rear connection tube 782. Each of the shock-absorbing portions 74 and 76 passes through the bridging member 78. In addition, there are a first and a second reinforced layers 80 and 82 made from a plurality of second carbonaceous fiber fabric sheets which are preimpregnated in epoxy resin and are composed of fibers arranged in a predetermined orientation. The first reinforced layer 80 is used to cover the surface of the front connection tube 781 and the surface of its neighboring outer shell 72 in such a manner that it is disposed across the contact portion between the end of the front connection tube 781 and the outer shell 72. The second reinforced layer 82 is used to cover the surface of the rear connection tube 782 and the surface of its neighboring outer shell 72 in such a manner that it is disposed across the contact portion between the end of the rear connection tube 782 and the outer shell 72. In addition, in order to ensure that the reinforced layers 80 and 82 are securely adhered to the front and the rear connection tubes 781 and 782, a plurality of grooves 784 are constructed in the surfaces of the front and the rear connection tubes 781 and 782. As a result, during the curing process of the reinforced layers 80 and 82, the pressures coming from the shock-absorbing portions 74 and 76 will cause the reinforced layers 80 and 82 to be forced into the grooves 784 so that the reinforced layers 80 and 82 are further securely adhered to the front and the rear connection tubes 781 and 782.

The shock wave traveling down through the shock-absorbing portions 74 and 76 from the head portion 64 of the racket 60 is partially absorbed by the bridging members 78, while the residual shock wave is effectively mitigated by the shock-absorbing portions 74 and 76, which contain less number of fiber fabric layers than other portions of the racket 60.

Now referring to FIGS. 8, 9, 10, 11, and 12, the racket 90 of the third preferred embodiment of the present invention is shown comprising a racket frame 92 having a head portion 94, a grip portion 96, and a shaft portion 98 connecting the head portion 94 and the grip portion 96. The shaft portion 98 is composed of two branches 981 and 982 extending toward the head portion 94. The grip portion 96 is covered with a protective jacket 100.

Figure 12:
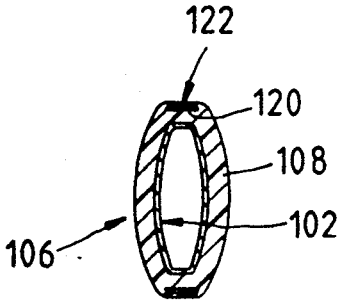
FIG. 12 is a sectional view of the portion taken along the line 12—12 as shown in FIG. 8, showing that the portion of fiber fabric located at the shock-absorbing portion is broken by interruption.

The racket frame 92 comprises a cellophane tube 102 and an outer shell 104. The cellophane tube 102 is wrapped around with six layers of the carbonaceous fiber fabric preimpregnated in epoxy resin and made up of fibers arranged in the orientations on the order of ±0°, ±30°, and ±45°. The outer shell 104 is provided with shock-absorbing portions 944 and 942 located respectively at the positions corresponding to three and nine of the clock in the frame of head portion 94. Each of the shock-absorbing portions 942 and 944 is composed of only three layers of fiber fabric. A tubular bridging member 106 made from polyethylene (PE), polyurethane (PU), and epoxy resin is provided with a main body 108 having at both ends thereof a front connection portion 110 and a rear connection portion 112. In the process of manufacturing the racket frame 92, the front and the rear connection portions 110 and 112 are put through the bridging member 106 at the time when the cellophane tube 102 and the outer shell 104 have not been cured. Thereafter, a first reinforced layer 114 and a second reinforced layer 116 are used to cover the surfaces of the front and the rear connection portions 110 and 112 and the surface of the segment of outer shell 104 adjacent to the front and the rear connection portions 110 and 112 in such a manner that the first and the second reinforced layers 114 and 116 are arranged across the bordering portion of the outer shell 104 and the front and the rear connection portions 110 and 112. The first and the second reinforced layers 114 and 116 are made respectively from four layers of carbonaceous fiber fabric preimpregnated in epoxy resin and made up of fibers arranged in the orientations of ±30° and ±45°. Upon completion of the curing process of outer shell 104, the first reinforced layer 114, and the second reinforced layer 116, the front and the rear connection portions 110 and 112 are securely adhered to the surfaces of the shock-absorbing portions 942 and 944, and to the first and the second reinforced layers 114 and 116. In order to enhance the association of front and rear connection portions 110 and 112 of the bridging member 106 with the first and the second reinforced layers 114 and 116 so as to sustain a greater impact, the front and the rear connection portions 110 and 112 are respectively provided with a plurality of dove tail grooves 118 parallel to the long axis thereof and spaced apart at a predetermined interval. Such dove tail grooves 118 are intended to permit the first and the second reinforced layers 114 and 116 to be embedded thereinto under pressure at the time when the curing process of the first and the second reinforced layers 114 and 116 is under way. In addition, the bridging member 106 is provided respectively on upper and lower sides thereof with a groove 120 along the entire length of the bridging member 106, as shown in FIG. 12. Such groove 120 is intended for use in embedding therein a third reinforced layer 122 made of carbonaceous fiber bundles preimpregnated in epoxy resin in order to reinforce the strength of the bridging member 106.

When the racket 90 hits a ball, the shock wave exerting on the horizontal strings located at positions corresponding to three and nine of the clock is effectively absorbed by the bridging members 106, while the shock wave exerting on the longitudinal strings located at positions corresponding to six and twelve of the clock is partially absorbed by the bridging members 106 of the shock-absorbing portions 942 and 944. As a result, the residual shock transmitted down to the grip portion 96 has been effectively mitigated to an extent that it does not cause an injury to the player's hand holding the racket 90.

What is claimed is:

1. An improved racket frame having a head portion, a grip portion, and a shaft portion located between said head portion and said grip portion, said racket frame comprising an outer shell made by compression molding a plurality of first fiber fabric sheets preimpregnated in thermosetting resin, said outer shell comprising: at least one shock-absorbing portion disposed at a bordering portion of said grip portion and said shaft portion in a direction toward said head portion so that its shock-absorbing portion is fitted into a tubular bridging of plastic material at a time when said outer shell has not been cured to form, and is further provided with a first reinforcing means and a second reinforcing means made respectively from a plurality of second fiber fabric sheets preimpregnated in a thermosetting resin and made up of fibers arranged in a predetermined orientation, said first reinforcing means covering a surface of one end of said bridging and a surface of said outer shell adjacent to said one end of said bridging while said second reinforcing means covers a surface of another end of said bridging and the surface of said outer shell adjacent to said another end of said bridging at the time when said first reinforcing means and said second reinforcing means have not cured to form to ensure that both ends of said bridging are secured in place between said shock-absorbing portion and said first and second reinforcing means upon completion of the curing of said first and second reinforcing means.

2. An improved racket frame according to claim 1, wherein said tubular bridging is made from polymeric material.

3. An improved racket frame according to claim 1, wherein said tubular bridging is made of two corresponding semi-tubular shell bodies.

4. An improved racket frame according to claim 1, wherein said shock-absorbing portion comprises fewer fiber fabric layers than other portions.

5. An improved racket frame according to claim 1, wherein each of said fiber fabric layers of said shock-absorbing portion is broken by interruption.

6. An improved racket frame according to claim 1 wherein said shaft portion of said racket frame comprises two branches extending toward said head portion.

7. An improved racket frame according to claim 6, wherein said shock absorbing portion is located at the bordering portion of said grip portion and said shaft portion such that it extends a predetermined length toward said branch.

8. An improved racket frame according to claim 7, wherein said bridging means comprises a pair of front branched tubes located corresponding to positions where said branches are covered by said shock-absorbing means.

9. An improved racket frame according to claim 6, wherein each of said branches is provided with a symmetrical shock-absorbing portion.

10. An improved racket frame according to claim 9, wherein said tubular bridging comprises a front connection tube, a rear connection tube, and a ridged portion made integrally with said front connection tube and said rear connection tube and located therebetween.

11. An improved racket frame according to claim 10, wherein said front connection tube and said rear connection tube comprise a plurality of grooves disposed on the surfaces thereof covered by said reinforcing means.

12. An improved racket frame according to claim 10, wherein said tubular bridging comprises on the surface thereof a groove extending throughout an entire length of said bridging and has a third reinforcing means embedded therein.

13. An improved racket frame according to claim 6, wherein said head portion comprises two shock-absorbing portions symmetrical to each other.

14. An improved racket frame according to claim 13, wherein said tubular bridging is provided with a main body having a size corresponding to an outer diameter of said outer shell, and front connection portion and a rear connection portion which extend outwardly from both ends of said main body, said reinforcing means covering the surface of each of said connection portions and the surface of said outer shell adjacent to each of said connection portions.

15. An improved racket frame according to claim 14, wherein each of said connection portions comprises thereon a plurality of grooves.

16. An improved racket frame according to claim 14, wherein said tubular bridging comprises thereon at least a groove extending throughout the entire length thereof and has a third reinforcing mean embedded therein.

* * * * *